US008590251B2

(12) United States Patent
Bandera

(10) Patent No.: US 8,590,251 B2
(45) Date of Patent: Nov. 26, 2013

(54) METAL FINISHING TILE, PRODUCTION METHOD AND RELATED COVERING

(75) Inventor: Ferdinando Bandera, Milan (IT)

(73) Assignee: Intersider Acciai S.p.A., Milan (IT)

( * ) Notice: Subject to any disclaimer, the term of this patent is extended or adjusted under 35 U.S.C. 154(b) by 0 days.

(21) Appl. No.: 11/922,474

(22) PCT Filed: Jun. 21, 2006

(86) PCT No.: PCT/IB2006/001675

§ 371 (c)(1),
(2), (4) Date: Dec. 19, 2007

(87) PCT Pub. No.: WO2006/136918

PCT Pub. Date: Dec. 28, 2006

(65) Prior Publication Data

US 2009/0025324 A1 Jan. 29, 2009

(30) Foreign Application Priority Data

Jun. 24, 2005 (IT) ..... MI2005A1199

(51) Int. Cl.
*E04B 2/00* (2006.01)

(52) U.S. Cl.
USPC ..... 52/588.1; 52/545; 52/589.1

(58) Field of Classification Search
USPC ..... 52/545, 543, 588.1, 589.1, 591.4, 591.5
See application file for complete search history.

(56) References Cited

U.S. PATENT DOCUMENTS 2,180,504 A * 11/1939 Bradfield et al. ..... 52/588.1
2,284,229 A * 5/1942 Palmer ..... 52/578
3,479,784 A * 11/1969 Massagli ..... 52/588.1
3,601,942 A * 8/1971 Wilson ..... 52/300
3,603,057 A * 9/1971 Curran ..... 52/478
3,961,454 A * 6/1976 Adams ..... 52/527
4,063,393 A * 12/1977 Toti ..... 52/245
4,100,711 A * 7/1978 Skuran ..... 52/489.2
4,122,643 A * 10/1978 Hafner ..... 52/520
4,130,975 A * 12/1978 Kelley ..... 52/588.1
4,195,459 A * 4/1980 Anderson ..... 52/394
4,218,857 A * 8/1980 Vallee ..... 52/94
4,292,781 A * 10/1981 Chalmers et al. ..... 52/547
4,422,274 A * 12/1983 Holliday ..... 52/410
4,445,305 A * 5/1984 Orie, Sr. ..... 52/309.9
4,601,147 A * 7/1986 Migliore ..... 52/275

(Continued)

FOREIGN PATENT DOCUMENTS

DE 2 155 117 5/1973
DE 2 249 839 4/1974

(Continued)

OTHER PUBLICATIONS

International Search Report dated Jun. 12, 2007.

(Continued)

*Primary Examiner* — William Gilbert
*Assistant Examiner* — James Ference
(74) *Attorney, Agent, or Firm* — Nixon & Vanderhye P.C.

(57) ABSTRACT

A tile is provided for covering surfaces in the form of one or more metallic plates. A substratum is to be placed on the surface to be covered. At least one metal plate has folds forming male and female shaped elements to be connected with those of adjacent tiles to form a substantially continuous coverage.

24 Claims, 3 Drawing Sheets

(56) References Cited

U.S. PATENT DOCUMENTS

| | | | | | |
|---|---|---|---|---|---|
| 4,769,963 | A * | 9/1988 | Meyerson | 52/309.9 |
| 4,870,795 | A * | 10/1989 | Bard et al. | 52/389 |
| 5,016,415 | A * | 5/1991 | Kellis | 52/522 |
| 5,165,213 | A * | 11/1992 | Finch et al. | 52/588.1 |
| 5,293,728 | A * | 3/1994 | Christopher et al. | 52/588.1 |
| 5,349,796 | A * | 9/1994 | Meyerson | 52/309.11 |
| 5,355,649 | A * | 10/1994 | Berridge | 52/520 |
| 5,410,849 | A * | 5/1995 | Christopher | 52/309.2 |
| 5,514,432 | A * | 5/1996 | Lisec | 428/35.8 |
| 5,613,337 | A * | 3/1997 | Plath et al. | 52/533 |
| 5,799,460 | A * | 9/1998 | Jensen | 52/530 |
| 5,860,265 | A * | 1/1999 | Knudson et al. | 52/846 |
| 5,930,964 | A * | 8/1999 | Boehning | 52/309.1 |
| 6,314,701 | B1 * | 11/2001 | Meyerson | 52/588.1 |
| 6,345,481 | B1 * | 2/2002 | Nelson | 52/592.2 |
| 6,393,792 | B1 * | 5/2002 | Mowery et al. | 52/520 |
| 6,418,686 | B1 * | 7/2002 | Record | 52/309.15 |
| 6,591,568 | B1 * | 7/2003 | Pålsson | 52/592.2 |
| RE38,210 | E * | 8/2003 | Plath et al. | 52/533 |
| 7,121,058 | B2 * | 10/2006 | Palsson et al. | 52/592.2 |
| 7,246,474 | B2 * | 7/2007 | Dombek et al. | 52/533 |
| 2003/0056457 | A1 * | 3/2003 | Zeeff | 52/520 |
| 2003/0205018 | A1 * | 11/2003 | Bentham et al. | 52/592.1 |

FOREIGN PATENT DOCUMENTS

| | | |
|---|---|---|
| DE | 2 447 489 | 4/1976 |
| DE | 24 46 489 | 4/1976 |
| DE | 41 15 660 | 11/1992 |
| DE | 100 29 744 | 4/2001 |
| EP | 01244060 | 9/1989 |
| EP | 1 428 953 | 11/2003 |

OTHER PUBLICATIONS

Written Opinion of the International Searching Authority.

* cited by examiner

METAL FINISHING TILE, PRODUCTION METHOD AND RELATED COVERING

This application is the U.S. national phase of International Application No. PCT/IB2006/001675 filed 21 Jun. 2006 which designated the U.S. and claims priority to IT MI2005A001199 filed 24 Jun. 2005, the entire contents of each of which are hereby incorporated herein by reference.

BACKGROUND AND SUMMARY OF THE INVENTION

The present invention concerns a tile built applying at least one metallic layer, in stainless steel or other metals, on a substratum like, for example, a sound-deadening or a thermosetting plastic material; a number of such tiles may be used to cover surfaces in the building field. Characteristic of these tiles is that the tile sides are properly shaped to join the tiles together to realize stable, plane and continuous coverings.

The surfaces to be covered could be horizontal, as a floor, or tilted, or vertical as building facades or inner walls. The tile structure is normally square or rectangular, even if there aren't limits to structure type provided that the sides are made to be joined together. The invention concerns also a corresponding method to realize such tiles and the coverings obtained installing the tiles on suitable plane surfaces. Similar tiles are known being made by a metal plate bonded, with various methods, to a substratum of a non metallic material like, but not only, a plastic material. To apply such tiles, multiple methods exists, but all of them are time consuming, need skilled people, and are costly. Moreover, the tile installation to the rough support requires costly adhesives or similar that frequently become a critical factor when exposed to humidity or to wide thermal excursions.

An object of the present invention is to propose a new tile of the type and for the applications just described, together with the method to realize it; the tile is carefully designed to make installation easy, fast and cheap without using adhesives to fix it to the basement.

BRIEF DESCRIPTION OF THE DRAWINGS

Further characteristics and advantages of the solution, according to the present invention, will be apparent from the description given below of preferred embodiments, given purely as an indicative example without limitations, with reference to the enclosed figures, in which.

DESCRIPTION OF THE PREFERRED EMBODIMENTS

Figure 1:
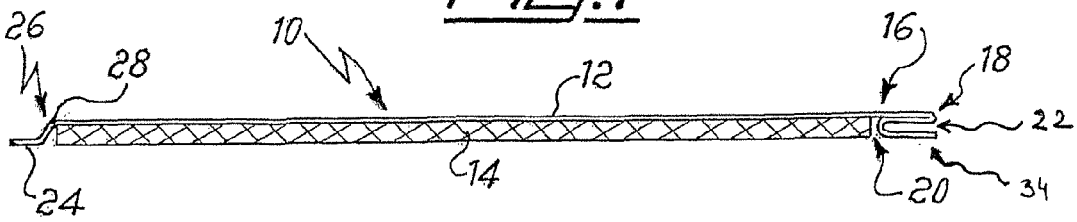
FIG. 1 illustrates, in a schematic way, a tile in section according to the invention.
Figure 2:
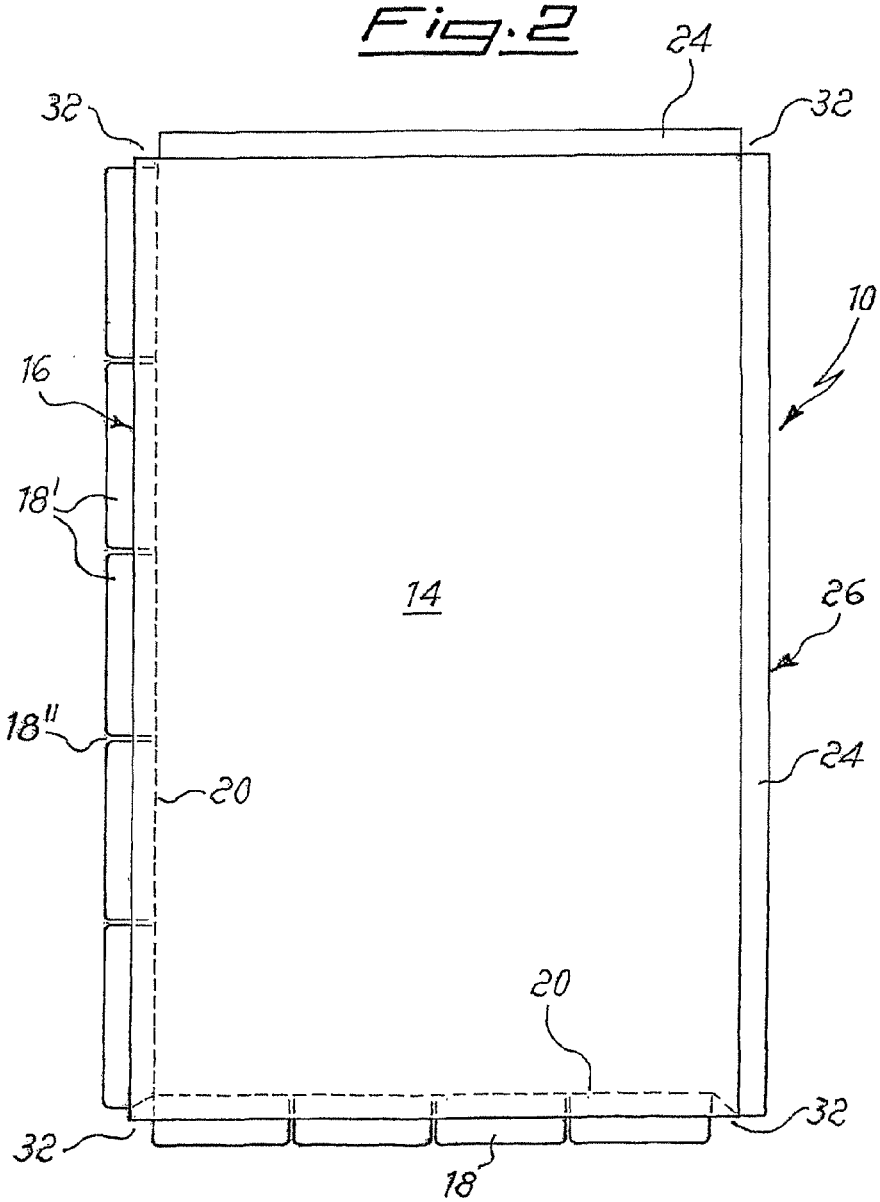
FIG. 2 is a plane view from the bottom of the tile of FIG. 1.

With reference in particular to FIGS. 1 and 2, a tile 10 is illustrated, the tile being composed by a metallic plate 12, preferably but not exclusively, in stainless steel, and by a suitable plane substratum 14, made as example by sound-deadening or thermosetting plastic material. The metallic plate 12, which is the stamping surface or the top external surface of the covering realized assembling these tiles, is coupled to the substratum 14 by any suitable way, like, as example by bonding with adhesive. Moreover, when out of ordinary mechanical performances are required, given that a single metallic layer cannot exceed a certain thickness because of the surface's shaping process, the tile could be built coupling more than one metallic plate, as example with two of them.

The tiles will be installed on a base surface to be covered, normally a plane surface, horizontal in case of floors or tilted as in case of slope coverings, or vertical when covering facades or internal walls.

To guide and join together adjacent tiles 10, each tile shows, on one side, or preferably on two consecutive sides, a female shaped joint; the opposite sides are properly male shaped, these elements being obtained by the edges of the metallic plate of which the tile is composed. It is important to highlight that the tile joints according to the present invention, are made of homogeneous material, in the case metal, folded without soldering or other complex workings. Moreover, as per FIGS. 1 and 2, where the tile shown has one metallic plate 12, the four lateral profiles are external to the substratum 14 and are properly folded to obtain the male and female joints. The method to get the female profile 16 is to make a first fold 18 of the ending side of the plate versus the tile inner, and a second fold 20, in the opposite direction to obtain an open "Z", with an externally facing seat 22 parallel to the tile side. The global thickness of the "Z" fold is a bit less of the total tile thickness, to assure planarity. The seat 22 of the female 16 is dimensioned to host a free edge 24 of a contiguous tile, the edge being part of a male element 26 as a result of folding down and then externally as in 28 the metallic side of the tile to obtain a substantially "L" shaped profile, where the free side 24 has a proper quote to perfectly fit inside the "V" seat 22.

With reference to FIG. 2, a rectangular tile 10 is illustrated, having two female elements 16 on two contiguous sides, and two male elements 26 on the contiguous opposite sides. To avoid metal interferences during folding and to close the tiles one near to the other during installation, the angles of the rough metal plate 12 are properly cut as per FIG. 2, detail 32. To be noticed that cuts at the angles are made to get a completely continuous and closed tile plane when installed. It's also possible to build tiles having only two joints, typically on the longest dimension, instead of the four shown and described; this two side insertion tile is preferred for long and tightened tiles and less expensive results.

Moreover, the female joints 16 can be formed by single sub-elements 18' obtained with cuts 18" perpendicular to the tile edge, and folding lines 20 can be previously traced on the tile rear surface to improve the folding precision.

Figure 3:
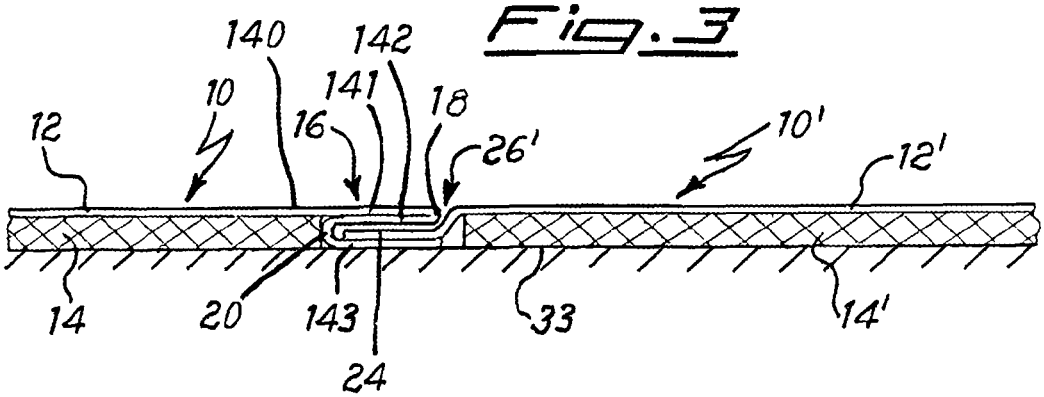
FIG. 3 is a section to show the details of the coupling of two tiles of the type represented by FIGS. 1 and 2.

With reference to FIG. 3, details of a couple of tiles are shown, to highlight the joint of a male element 26' and of a female element 16, belonging to two adjacent tiles 10' and 10 covering a surface 33. The female element 16 by the first fold 18 defines an external tile surface 140 and an internal tile surface 141. As shown, a U-shape is defined by the first fold 18 and the second fold 20, including a first edge portion 142 and a second edge portion 143. The first edge portion 142 is parallel to the surface to be covered and contacts the internal tile surface 141. The second edge portion 143 rests on the surface to be covered 33. The free edge 24 of the male element 26 is parallel to the surface to be covered 33 and is positioned inside a seat defined by the U-shape of the female element 16.

Figure 4:
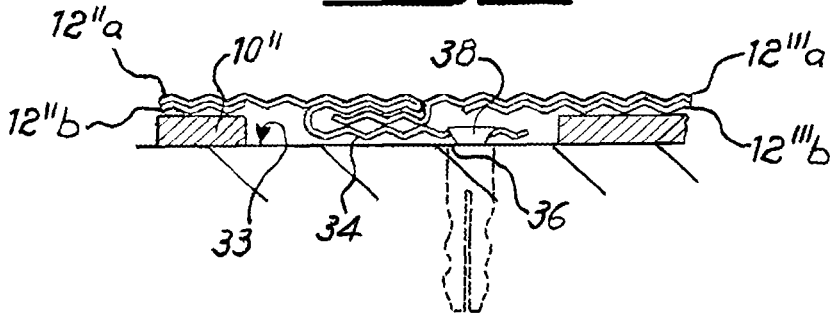
FIG. 4 shows in a section details of the possible installation of a tile to the basement and reinforced tiles having two metal layers.

When the surface 33 is horizontal, it's normally not necessary to fix the tiles to the surface; anyhow, in case where the fixing is desired or preferable, the female free edge 34 can be foreseen few millimeters longer to accept fixing screws, 38 on holes 36, as shown in FIG. 4. FIG. 4 illustrates two tiles 10" and 10'", having metal plates 12"*a*, 12"*b* and 12'"*a*, 12'"*b* respectively, the male and female profiles being obtained by folding the metal plane of the external plates 12"*a* and 12'"*a*.

However, the male and female joints can be obtained by folding the inner plates 12"*b* and 12'"*b*.

An even simpler fixing is possible on the "L" shaped side as it happens at the ending lane of the coverings.

Due to the characteristics of the present invention, the installation of tiles is simple, fast, and precise; and the covering is aesthetically very clean, without visible screws with the metal tiles quite continuous. The metal joints, as made, allow the recovery of small planarity defects frequently present on the base rough surfaces, and compensate the dimensional changes due to temperature variation. An important advantage of the invention is that the metal tiles are electrically interconnected by a practically infinite number of points, which makes very simple the metal grounding of the complete covering when requested.

Figure 5:
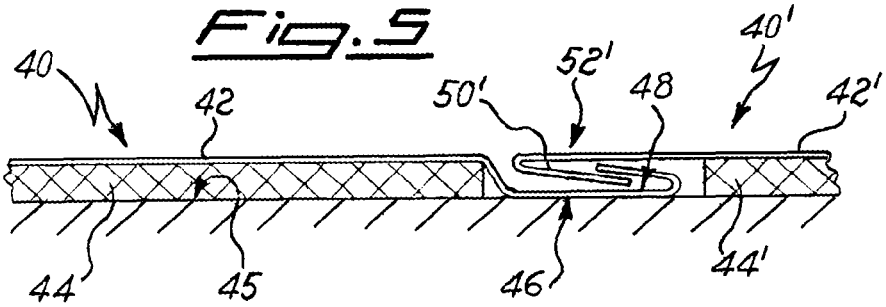
FIG. 5 shows a different realization of the tile's coupling.

With reference to FIG. 5, a different form of the invention is shown; with reference to two tiles 40 and 40', each having a metal plate 42 and 42', coupled with a substratum 44 and 44', standing on a surface 45. As per this implementation, the female joint element 46 is built folding the metal edge firstly down and secondly up; this realizes a "V" seat 48, where to insert a free folded down edge 50" of the male element 52. Also with this implementation the joints could be two or four on the sides of each tile.

Figure 6:
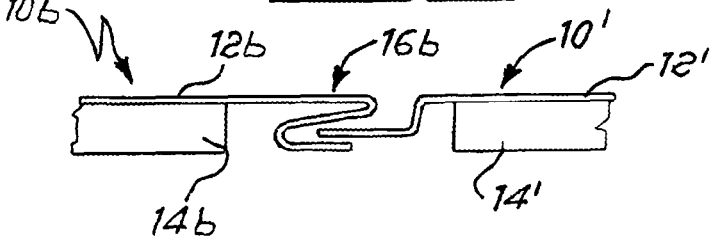
FIG. 6 shows the same coupling of the previous FIG. 3, modified to allow the removal of a single tile from a complete pavement.
Figure 7:
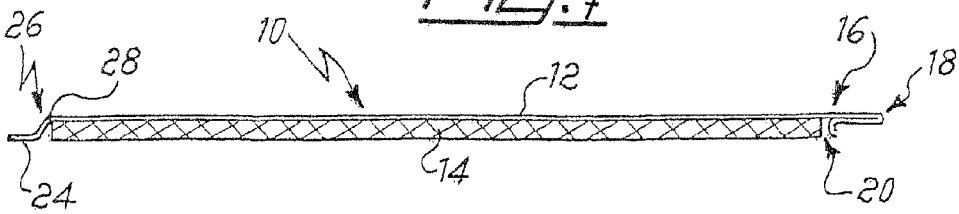
FIGS. 7 and 8 show "jolly" tiles without an inner female edge or with a shorter inner female edge, respectively.
Figure 8:
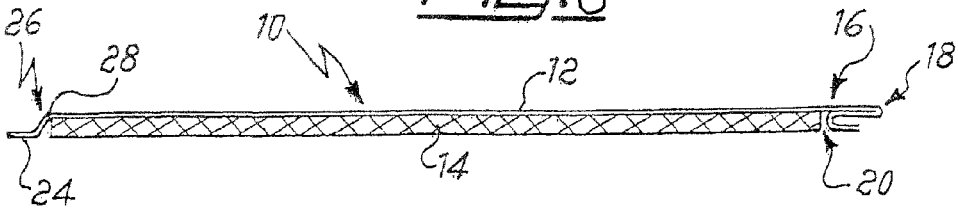

It's a general good practice to simplify the replacement of eventually damaged tiles or to give access to under covering installations, to interpose to normal tiles special easily removable "jolly" tiles without joints (FIG. 7) or with joints of reduced length (FIG. 8) as shown in FIG. 6 which corresponds to FIG. 3 with the difference that the joining "Z" profile 16*h* of the tile 10*h* has an inner edge shorter than the equivalent one of the tile 10 in FIG. 3.

As an alternative (not shown), the "jolly" tiles can be formed without joints and maintained in position on the ground surface by means of magnetic attraction between permanent magnetically attracting elements, embedded in the ground surface and in the bottom surface of the tile substratum.

To build the tiles, according to the present invention, a metal plate is properly cut at dimension, and the plate corners are cut with a number of additional cuts made as beneficial to the precision of the folding process; as example, the line of folding can be properly engraved to improve precision.

The plate is then folded, in multiple steps, to get the tile metal plate complete with its female and male side profiles. Finally the tile is assembled with an eventual second metal plate and the substratum. The covering made without screws with tiles produced as per the invention, keeps the lower surface exactly as it was before. This is very desirable and allows temporary installations and tile reusability, which are important characteristics for a number of applications, as example like the fair stands floors or the technical floors.

In conclusion, the present invention realizes, with limited investments, simple, flexible and cheap metal covering tiles characterized by an easy, adhesive free installation method, and by a very clean aesthetic, without visible screws or other heterogeneous components. The peculiarity of the metal joint is beneficial to recover the small planarity defects of the installation surface, important to compensate dimensional changes due to the thermal excursion and allows easy electrical grounding.

The invention claimed is:

1. A tile for covering floors, comprising one or more metallic plates having an external tile surface and an internal tile surface, said tile being placed on a rough surface, at least one of said metallic plates is provided, on at least two opposite sides, with folds forming complementary male and female shaped coupling elements for reciprocal insertion joints, standing between an external tile surface and the rough surface, each female insertion and coupling element being shaped to receive and retain a complementary male insertion and coupling element of an adjacent tile, wherein the female insertion and coupling element comprises an open Z-shape comprising a first fold defining an external outside end of the metallic plate that is folded toward and into overlaying contact with an internal surface of the metallic plate and a second fold in an opposite direction such that the metallic plate extends into alignment with the external outside end of the metallic plate defining an external inside end of the metallic plate, wherein the internal surface of a portion of the metallic plate after the second fold that extends into alignment with the external outside end of the metallic plate is positioned to rest on the rough surface, and wherein the male insertion and coupling element has an L-shape that comprises a fold down across a thickness of the tile and has a free edge that is positioned to be parallel to the rough surface, wherein said free edge is configured to enter inside a U-shape shape portion of the Z-shape defined by the second fold of the female insertion and coupling element of the adjacent tile in such a way to form a continuous and closed tile plane.

2. A tile, according to claim 1, wherein the insertion and coupling elements are made by folding the tile metal plate and are external with respect to a substratum plate to which the tile is fixed.

3. A tile, according to claim 2, wherein said substratum plate for placement on the rough surface comprises a sound-deadening material.

4. A tile, according to claim 2, wherein said substratum plate for placement on the rough surface is made of plastic material, preferably a thermosetting one.

5. A tile, according to claim 1, wherein the insertion and coupling elements extend along a related tile lane, with the exception of tile corners.

6. A tile, according to claim 1, wherein a tile plane is limited from the one or more metallic plates on four corners.

7. A tile, according to claim 1, comprising a female insertion and coupling element on one side only of the tile and a corresponding male insertion and coupling element on an opposite tile side.

8. A tile, according to claim 1, comprising two female insertion and coupling elements on two contiguous sides of the tile and two male insertion and coupling elements on the other contiguous sides.

9. A tile, according to claim 1, wherein the second edge portion has one or more openings to allow the tile fixing with screws or other elements to the surface to be covered.

10. A tile, according to claim 1, comprising at least two metallic overlapped plates and said plane substratum, wherein the male and female coupling elements are part of the more external metal plate.

11. A tile, according to claim 1, comprising at least two metallic overlapped plates and said plane substratum, wherein the male and female coupling elements are part of the more internal metal plate.

12. A covering for floors realized with a number of tiles as defined according to claim 1, having complementary coupling elements for keeping the tiles closed.

13. A covering according to claim 12, wherein one or more "jolly" tiles are missing of one or more insertion joints to facilitate a partial or complete removal of an installed covering.

14. A covering according to claim 12, wherein one or more "jolly" tiles have one or more shorter insertion joints to facilitate a partial or complete removal of an installed covering.

15. A covering according to claim 12, wherein one or more tiles are standing on a covered surface, without being fixed or interfering with such surface.

16. A covering according to claim 12, wherein the covering is applied on a floating floor.

17. A covering according to claim 12, wherein at least one of the metallic tiles is electrically grounded.

18. A method for producing the tile defined in claim 1, comprising the steps of:

cut to measure and cut the corners of a metallic plate to get plates ready to produce metallic tiles;

folding two or four sides of each tile metallic plate to form one or two insertion and coupling female elements and one or two male insertion and coupling elements;

add in case additional metallic plates; and add a plane substratum.

19. A method according to claim 18, wherein the folds of said female insertion and coupling elements are pressed to get thickness lower than the one of the tile.

20. A method according to claim 18, comprising performing cuts or line marking on the metal plate to improve the precision of the subsequent folding operation.

21. A tile according to claim 1, wherein the female coupling element comprises a "Z" shaped folded edge of the metallic plate, and wherein said "Z" shaped folded edge is formed by a plurality of "Z" shaped parallel parts separated by cuts perpendicular to said "Z" folded edge.

22. A tile, according to claim 1, wherein the metallic plates are formed of stainless steel.

23. A tile, according to claim 1, having four sides, wherein each of the four sides comprises the folds forming one of the complementary male and female shaped coupling elements.

24. A tile, according to claim 23, wherein two female shaped coupling elements are disposed on a first two contiguous sides of the four sides, and wherein two male shaped coupling elements are disposed on a second two contiguous sides of the four sides.

* * * * *